US008034197B2

(12) United States Patent
Garrison, Jr.

(10) Patent No.: US 8,034,197 B2
(45) Date of Patent: Oct. 11, 2011

(54) ULTRA-HIGH STRENGTH STAINLESS STEELS

(75) Inventor: Warren M. Garrison, Jr., Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 12/141,595

(22) Filed: Jun. 18, 2008

(65) Prior Publication Data

US 2009/0081068 A1 Mar. 26, 2009

Related U.S. Application Data

(60) Provisional application No. 60/936,305, filed on Jun. 19, 2007, provisional application No. 60/959,656, filed on Jul. 16, 2007.

(51) Int. Cl.
*C22C 38/00* (2006.01)

(52) U.S. Cl. ..... 148/325; 148/326; 420/36; 420/37; 420/38

(58) Field of Classification Search ..... 148/325, 148/326; 420/36, 37, 38
See application file for complete search history.

(56) References Cited

U.S. PATENT DOCUMENTS 4,196,878 A * 4/1980 Michel ..... 244/108
4,627,959 A * 12/1986 Gilman et al. ..... 419/61
4,647,304 A * 3/1987 Petkovic-Luton et al. ..... 75/354

FOREIGN PATENT DOCUMENTS

CH 650026 * 6/1985
CN 1214374 * 4/1999
FR 2887558 * 12/2006
SU 438723 * 8/1974

OTHER PUBLICATIONS

Asayama, Yukiteru, "Notch Toughness Characteristics of High Strength Maraging Stainless Steel", J. Japan Inst. Metals, vol. 40, No. 5 (1976), pp. 533-541, English abstract attached.

Asayama, Yukiteru, "The Effect of Aging on the Notch Toughness of High Strength Maraging Stainless Steels", J. Japan Inst. Metals, vol. 41, No. 10 (1977), pp. 973-981, English abstract attached.

Asayama, Yukiteru, "Study on Aging Embrittlement of High Strength Maraging Stainless Steels", J. Japan Inst. Metals, vol. 42, No. 7 (1978), pp. 649-658, English abstract attached.

* cited by examiner

*Primary Examiner* — Sikyin Ip
(74) *Attorney, Agent, or Firm* — The Webb Law Firm

(57) ABSTRACT

An ultra-high strength stainless steel alloy with enhanced toughness includes in % by weight: 0 to 0.06% carbon (C); 12.0 to 18% chromium (Cr); 16.5 to 31.0% cobalt (Co); 0 to 8% molybdenum (Mo); 0.5 to 5.0% nickel (Ni); 0 to 0.5% titanium (Ti); 0 to 1.0% niobium (Nb); 0 to 0.5% vanadium (V); 0 to 16% tungsten (W); balance iron (Fe) and incidental deoxidizers and impurities. The heat treating method includes the steps of austenitizing at least once followed by quenching, tempering and sub-zero cooling to obtain no more than about 6-8% retained austenite in the finished alloy.

10 Claims, 1 Drawing Sheet

The yield strength plotted as a function of tempering temperature for cobalt levels of 9, 12, 15, 18 and 21 wt. %

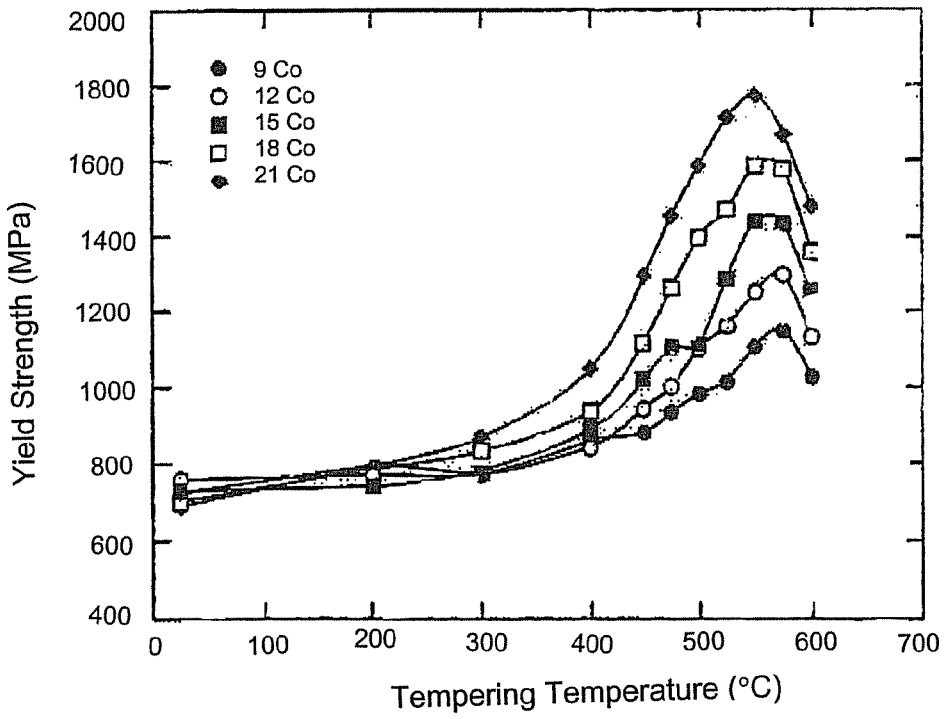
Figure : The yield strength plotted as a function of tempering temperature for cobalt levels of 9, 12, 15, 18 and 21 wt. %

ULTRA-HIGH STRENGTH STAINLESS STEELS

CROSS REFERENCE TO RELATED APPLICATIONS

This application claims priority benefits of U.S. Provisional Application No. 60/936,305 filed Jun. 19, 2007, and U.S. Provisional Application No. 60/959,656 filed Jul. 16, 2007, both of which are incorporated herein by reference in their entirety.

STATEMENT REGARDING FEDERALLY SPONSORED RESEARCH

The research was funded under NSF Award 0400434 and reported on Jun. 4, 2008, to the NSF in a Final Report entitled "The Effects of Nickel and Carbon Content on the Toughness of Ultra-High Strength Precipitation Strengthened Stainless Steel" which Final Report (allotted NSF Report Number 3403121) is incorporated in its entirety by reference herein.

BACKGROUND OF THE INVENTION

1. Field of the Invention

The invention relates generally to the field of metallurgy and, more particularly, to ultra-high strength stainless steel with enhanced toughness which is suitable for applications such as aircraft landing gear, high strength bolts, airframe parts and the like.

2. Description of Related Art

For many years, low alloy steels such as 300 M plated with cadmium have been used in the manufacture of aircraft landing gear. Cadmium is used to improve corrosion resistance of the underlying high strength steel but comes at a cost of environmental problems associated with cadmium. There is, thus, a strong motivation to develop an alloy which has the needed strength and toughness for landing gear applications but which is more environmentally friendly. It is known that 300 M has a very good combination of strength (280 to 305 ksi), toughness, fatigue strength and good ductility but, as noted, is not resistant to corrosion. Accordingly, there is a need for an ultra-high strength stainless steel with good toughness. Stainless steels of this type have received little attention since the work of Asayama in the early 1970s, see Asayama articles "Notch Toughness Characteristics of High Strength Maraging Stainless Steel", *Jpn. Inst. Of Metals Journal,* 1976, 40, No. 5, p. 533; "The Effect of Aging on the Notch Toughness of High Strength Maraging Stainless Steels", *Jpn. Inst. of Metals Journal,* 1977, 41, No. 10, p. 973; and "Study on Aging Embrittlement of High Strength Maraging Stainless Steels", *Nippon Kinzokee Gakkaishi,* 1978, 42, No. 7, p. 649.

SUMMARY OF THE INVENTION

The present invention is directed to an ultra-high strength stainless steel with enhanced toughness for use in the manufacture of aircraft landing gear applications and the like, replacing the need for conventional cadmium plated low alloy steels such as 300 M. Briefly stated, the stainless steel alloy of the present invention comprises, in % by weight: 0 to 0.06% carbon (C); 12.0 to 18% chromium (Cr); 16.5 to 31.0% cobalt (Co); 0 to 8% molybdenum (Mo); 0.5 to 5.0 nickel (Ni); 0 to 0.5% titanium (Ti); 0 to 1.0% niobium (Nb); 0 to 0.5% vanadium (V); 0 to 16% tungsten (W); balance iron (Fe) and incidental deoxidizers and impurities. The alloy of the invention contains at least one of or both of molybdenum and tungsten. In the case of no molybdenum, the alloy contains 6 to 16 wt % tungsten, and in the case of no tungsten, the alloy contains 3 to 8 wt % molybdenum. When the present alloy contains both molybdenum and tungsten, a total of 1.5 to 6 atomic % (Mo+W) is present. The steel has a yield strength ranging from about 1600 MPa to about 1800 MPa and is strengthened by the precipitation of intermetallic compounds.

A process according to the present invention includes the steps of providing an alloy of the above composition, followed by austenitizing, cooling to room temperature, and optionally further cooling from room temperature to about −100° C. to preferably reduce the retained austenite to about 6 to 8 vol. % followed by tempering.

BRIEF DESCRIPTION OF THE DRAWING

The FIGURE is a plot of yield strength as a function of tempering temperature for cobalt levels of 9, 12, 15, 18 and 21 wt %.

DETAILED DESCRIPTION OF THE INVENTION

In order to achieve the desired combination of strength, toughness and corrosion resistance required for aircraft landing gear in a martensitic stainless alloy, the alloying elements must be carefully balanced. The alloying additions must be sufficient to create the necessary strength, yet the martensite start temperature must remain high enough to avoid excessive (above about 8%) retained austenite upon quenching and tempering either with or without a refrigeration step in between. Excessive retained austenite will result in lower strength. While all alloying elements affect the strength and the martensite start temperature, the magnitude of the effect is different for each element.

In order to achieve the desired high strength levels, Co, Cr and one or more of Mo and W are necessary to form the necessary R-phase strengthening precipitates. In this invention, the Co is kept high, above 16 wt. %, for two reasons. First, in the presence of Cr and one or more of Mo and W, it modifies the composition of the R-phase precipitates enhancing the strengthening effect that is seen with additions of any of these elements alone. Second, for a given addition of Co, greater strength can be achieved with less of an effect on martensite start temperature than can be achieved with other alloying elements. The effect of Co on yield strength, toughness (Charpy Energy), and hardness can be seen in the FIGURE. The FIGURE shows the yield strengths for the compositions given in Table 1 as a function of tempering temperature and cobalt content. Table 3 gives the toughness (Charpy Energy) and hardness for the compositions listed in Table 2.

TABLE 1

Compositions to Investigate the Effect of Cobalt on Strength
Compositions in wt %

| Alloy | C | Cr | Co | Mo | Ni | Al | S* | P* | $P_2$* | $N_2$* |
|---|---|---|---|---|---|---|---|---|---|---|
| WP09 | 0.004 | 12.06 | 9.04 | 5.01 | 1.51 | — | 31 | 9 | 173 | 8 |
| WP10 | 0.002 | 12.1 | 11.95 | 4.98 | 1.5 | — | 32 | 8 | 200 | 6 |
| WP11 | 0.004 | 11.97 | 14.91 | 5.03 | 1.5 | — | 32 | 7 | 160 | 7 |
| WP12 | 0.004 | 11.99 | 17.89 | 5.05 | 1.5 | — | 24 | 7 | 160 | 6 |
| WP13 | 0.005 | 11.93 | 20.75 | 5.04 | 1.48 | — | 26 | 6 | 163 | 6 |

*wt. ppm

TABLE 2

| Nominal Compositions in wt. % Alloys to Use to Assess Toughness | | | | | | |
|---|---|---|---|---|---|---|
| Alloy | C | Cr | Co | Mo | Ni | Ti |
| WP61-1 | 0.005 | 14 | 18 | 5 | 1.5 | 0 |
| WP61-2 | 0.005 | 14 | 19.5 | 5 | 1.5 | 0 |
| WP61-3 | 0.005 | 14 | 21 | 5 | 1.5 | 0 |
| WP62-1 | 0.025 | 14 | 16 | 5 | 1.5 | 0.025 |
| WP62-2 | 0.025 | 14 | 17 | 5 | 1.5 | 0.025 |
| WP62-3 | 0.025 | 14 | 18 | 5 | 1.5 | 0.025 |

TABLE 3

| Mechanical Properties of Experimental Heats | | |
|---|---|---|
| Alloy | Charpy Energy (J) | Hardness ($R_c$) |
| WP61-1 | 19.2 | 52.7 |
| WP61-2 | 32.9 | 53.6 |
| WP61-3 | 26.1 | 54.4 |
| WP62-1 | 23.9 | 52.5 |
| WP62-2 | 25.1 | 52.9 |
| WP62-3 | 29.6 | 53.7 |

Mo and W may be used interchangeably with one another or in combination. However, W provides about 2.5 times the increase in strength per 1 wt. % addition than Mo does.

Nickel has a large effect on martensite start temperature (−80 C/wt. %) and thus the amount of retained austenite after heat treating. Therefore, nickel additions need to be kept low (<5.0 wt. %). However, nickel additions are necessary to increase toughness and to assure that some retained austenite remains after heat treating, preferably 6-8%. This limited amount of retained austenite is required to assure that the ductile to brittle transition temperature of the alloy remains low (DEBTT) and toughness remains as high as possible. Thus, the high cobalt, low nickel composition of this alloy results in a material with high strength (YS—1650 MPa, UTS—1900 MPa, $R_c$—54-55) and good toughness (18 ft/lbs).

Chromium is also necessary to provide corrosion resistance. The corrosion resistance is a result of the formation of chromium oxides which readily form on the surface of the steel. Increasing the chromium levels will improve the corrosion resistance and will also increase strength slightly.

Carbon additions can increase strength either by remaining in solid solution or by combining with Mo and Cr on tempering to form small precipitates. Further, carbon additions in combination with additions of Ti, Nb and/or V will result in the formation of carbide or carbo-nitride precipitates which will restrict grain growth during austenitizing, keeping the grain size small. These precipitates also act to getter sulfur and are much more resistant to void formation than typical sulfur precipitates, resulting in improved toughness.

A martensitic stainless alloy that achieves the desired balancing of alloy additions to attain high strength without sacrificing toughness and have good corrosion resistance without coating comprises:

Carbon: 0.0 to 0.07 wt %
Chromium: 10 to 18 wt %
Nickel: 0.5 to 5.0 wt %
Cobalt: 16.5 to 31 wt %
Titanium: 0 to 0.5 wt %
Niobium: 0 to 1.0 wt %
Vanadium: 0 to 05 wt %
and either
Molybdenum: 3 to 9 wt %
or Tungsten: 5.7 to 17.2 wt %
or Molybdenum+Tungsten: 1.5 to 5.5 atomic %.

More preferably, the alloy comprises:

Carbon: 0.0 to 0.06 wt %
Chromium: 11 to 17 wt %
Nickel: 0.5 to 4.5 wt %
Cobalt: 16.5 to 28 wt %
Titanium: 0 to 0.4 wt %
Niobium: 0 to 0.8 wt %
Vanadium: 0 to 0.3 wt %
and either
Molybdenum: 3 to 8 wt %
or Tungsten: 5.7 to 15.4 wt %
or Molybdenum+Tungsten: 1.5 to 4.4 atomic %.

Most preferably, the alloy comprises:

Carbon: 0.0 to 0.055 wt %
Chromium: 11 to 16 wt %
Nickel: 0.5 to 4.0 wt %
Cobalt: 16.5 to 26 wt %
Titanium: 0 to 0.4 wt %
Niobium: 0 to 0.8 wt %
Vanadium: 0 to 0.2 wt %
and either
Molybdenum: 3 to 7.5 wt %
or Tungsten: 5.7 to 14.3 wt %
or Molybdenum+Tungsten: 1.5 to 4.4 atomic %.

Preferred embodiment: 0.005-0.050 wt % C, 12-14 wt % Cr, 19-21 wt % Co, 4.5-5.5 wt % Mo, and 1.0-2.0 wt % Ni. A presently preferred nominal composition of the present invention is (in wt %): 0.02 C, 14 Cr, 20 Co, 5 Mo, 1.5 Ni, balance Fe.

The alloy may also contain low levels of manganese or rare earth additions to getter sulfur and increase toughness. Trace amounts of aluminum and silicon from deoxidation during melting may also be present.

Heat treating of these alloys is achieved by austenitizing from 900-1050° C., quenching to room temperature using either air or oil, and tempering from 475-575° C. A sub-zero (−100° C.) cooling step may be added between quenching and tempering to assure that no more than 6-8% is retained in the finished alloy. Higher austenitizing temperatures result in higher toughness with little or no change in strength. Refrigeration increases strength slightly with only a slight corresponding decrease in toughness. Increasing tempering temperature will increase both strength and toughness up to about 525-550° C. where both properties start to decline as tempering temperature is increased further. Longer tempering times result in increased hardness but toughness is sacrificed. Double austenitizing followed by quenching, tempering and sub-zero cooling may also be employed to further enhance toughness.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. An ultra-high strength stainless steel alloy with enhanced toughness consisting essentially of in % by weight:

0 to 0.06% carbon (C);
12.0 to 18% chromium (Cr);

16.5 to 31.0% cobalt (Co);
0 to 8% molybdenum (Mo);
0.5 to 5.0% nickel (Ni);
0 to 0.5% titanium (Ti);
0 to 1.0% niobium (Nb);
0 to 0.5% vanadium (V);
0 to 16% tungsten (W);
balance iron (Fe) and incidental impurities,
wherein the alloy has a yield strength of 1600-1800 MPa and a microstructure of martensite and retained austenite.

2. Aircraft landing gear made from the alloy of claim 1.

3. The alloy of claim 1 containing no W and 3 to 8% Mo.

4. Aircraft landing gear made from the alloy of claim 3.

5. An ultra-high strength stainless steel alloy with enhanced toughness comprising in % by weight:
0 to 0.06% carbon (C);
12.0 to 18% chromium (Cr);
16.5 to 31.0% cobalt (Co);
0.5 to 5.0% nickel (Ni);
0 to 0.5% titanium (Ti);
0 to 1.0% niobium (Nb);
0 to 0.5% vanadium (V);
6 to 16% tungsten (W);
balance iron (Fe) and incidental impurities,
wherein the alloy has a yield strength of 1600-1800 MPa and a microstructure of martensite and retained austenite.

6. Aircraft landing gear made from the alloy of claim 5.

7. An ultra-high strength stainless steel alloy with enhanced toughness comprising in % by weight:
0 to 0.06% carbon (C);
12.0 to 18% chromium (Cr);
16.5 to 31.0% cobalt (Co);
0.5 to 5.0% nickel (Ni);
0 to 0.5% titanium (Ti);
0 to 1.0% niobium (Nb);
0 to 0.5% vanadium (V);
balance iron (Fe) and incidental impurities,
wherein Mo is >0 atomic % and <6 atomic %, W is >0 atomic % and <6 atomic % and Mo+W is 1.5-6.0 atomic %; and
the alloy has a yield strength of 1600-1800 MPa and a microstructure of martensite and retained austenite.

8. Aircraft landing gear made from the alloy of claim 7.

9. An ultra-high strength stainless steel alloy with enhanced toughness comprising in % by weight:
0 to 0.06% carbon (C);
12.0 to 18% chromium (Cr);
16.5 to 31.0% cobalt (Co);
4.5 to 8% molybdenum (Mo);
0.5 to 5.0% nickel (Ni);
0 to 0.5% titanium (Ti);
0 to 1.0% niobium (Nb);
0 to 0.5% vanadium (V);
0 to 16% tungsten (W);
balance iron (Fe) and incidental impurities,
wherein the alloy has a yield strength of 1600-1800 MPa and a microstructure of martensite and retained austenite.

10. Aircraft landing gear made from the alloy of claim 9.

* * * * *